US005984027A

United States Patent [19]

Kato

[11] Patent Number: 5,984,027

[45] Date of Patent: Nov. 16, 1999

[54] ENGINE-DRIVEN BREAKER

[75] Inventor: Tetsuya Kato, Mishima, Japan

[73] Assignee: Maruzen Kogyo Company Ltd., Shizuoka, Japan

[21] Appl. No.: 08/745,258

[22] Filed: Nov. 8, 1996

[51] Int. Cl.[6] ..... E21B 1/00; B25D 9/10

[52] U.S. Cl. ..... 175/135; 173/200

[58] Field of Search ..... 175/135, 170, 175/293, 296; 173/200, 201, 206

[56] References Cited

U.S. PATENT DOCUMENTS

| | | | |
|---|---|---|---|
| 3,570,608 | 3/1971 | Erma | 173/201 |
| 4,222,443 | 9/1980 | Chromy | 173/201 |
| 4,582,144 | 4/1986 | Mizutani | 173/14 X |
| 4,609,053 | 9/1986 | Ragnmark | 173/104 |
| 4,611,670 | 9/1986 | Chromy | 173/104 X |
| 5,052,498 | 10/1991 | Gustafsson et al. | 173/118 |
| 5,097,913 | 3/1992 | Gustafsson | 173/210 |

*Primary Examiner*—Frank Tsay
*Attorney, Agent, or Firm*—Michael J. Striker

[57] ABSTRACT

An engine-driven breaker which is capable of providing a breaking force equal to that of a hydraulic or pneumatic breaker even with a small engine and which is small and light and easy to handle and has a simple construction enabling it to be manufactured cheaply. The engine-driven breaker has a breaker main body and a cylinder fixed inside the breaker main body and inside the cylinder an upper air chamber of variable volume is provided between an operating piston and a hammer piston and a lower air chamber of variable volume is provided below the hammer piston. An annular air passage connected by way of a throttling passage to a crank chamber housing a crank mechanism driving the operating piston is provided between the outer peripheral wall of the cylinder and the inside wall of the breaker main body, and first air holes and second air holes are provided in the cylinder wall passing through to the annular air passage in a position corresponding to a bottom dead center position of the hammer piston and in a position below that respectively. Upper air holes for connecting the upper air chamber and the crank chamber are also provided in the cylinder wall in the crank chamber just below a top dead center position of the operating piston.

5 Claims, 8 Drawing Sheets

ENGINE-DRIVEN BREAKER

BACKGROUND OF THE INVENTION

1. Field of the Invention

This invention relates to an engine-driven breaker.

2. Description of the Prior Art

Known hand-held breakers for breaking concrete, rock and asphalt and the like include hydraulically driven breakers and pneumatically driven breakers.

These breakers are small and can provide relatively large breaking forces, but because they require large accompanying apparatuses such as hydraulic units and compressors there has been the problem that they can only be used at sites to which these driving apparatuses can be transported and within the reach of a connecting hose.

To solve this problem, engine-driven breakers have been being developed and used. An engine-driven breaker has the merit that it does not require an accompanying apparatus such as a hydraulic pressure source or a compressed air source and can be used anywhere as long as there is fuel.

However, conventional engine-driven breakers have been inferior to hydraulically driven breakers and pneumatically driven breakers in their breaking force. Consequently, there has been the problem that to obtain a necessary breaking performance it is necessary to mount a large engine and as a result the weight of the breaker increases and its ease of handling and operability deteriorate.

SUMMARY OF THE INVENTION

The present invention was made to solve the above-mentioned problems, and an object of the invention is to provide a new engine-driven breaker which is capable of providing an excellent breaking force equal to that of a hydraulic or pneumatic breaker using a small engine and which therefore is small and light and easy to handle.

To achieve the above-mentioned object and other objects, the invention improves the striking mechanism in an engine breaker and raises the efficiency with which engine power is converted into striking force.

That is, an engine-driven breaker of the invention comprises a cylindrical breaker main body having an upper end closed by a ceiling wall and divided into upper and lower parts by a partition wall located part-way in the height direction and having a tool attached thereto below the partition wall; a cylinder fixed inside the breaker main body concentrically with the tool above the partition wall; a hammer piston having a piston part and a rod part, the piston part being slidably fitted inside the cylinder and the rod part extending downward through the partition wall, which hammer piston strikes the tool with the rod part when the piston part descends; an engine mounted on the outside of the breaker main body; and an operating piston slidably fitted inside the cylinder above the piston part and raised and lowered by a crank mechanism connected to the engine.

An upper air chamber of variable volume is formed between the piston part of the hammer piston and the operating piston and a lower air chamber of variable volume is formed between the piston part of the hammer piston and a cylinder bottom of the cylinder; a throttling passage is provided between the outer periphery of the cylinder and the inner periphery of the breaker main body and an annular air passage and a crank chamber housing the crank mechanism are formed respectively below and above this throttling passage as a boundary.

A first air hole connecting with the annular air passage and closed by the piston part when the hammer piston reaches a bottom dead center position is provided in the circumferential wall of the cylinder and a second air hole always connecting the annular air passage and the lower air chamber is provided in the cylinder wall below the bottom dead center position of the hammer piston. Also, an upper air hole for connecting the upper air chamber and the crank chamber is provided in a part of the cylinder wall positioned inside the crank chamber in a position at a height level above the throttling passage and below the top dead center position of the operating piston.

With this construction of the invention, in the period during which the hammer piston ascends it is possible to introduce air from the crank chamber into the upper air chamber through the upper air hole and make it act on the upper surface of the piston part of the hammer piston and thereby apply a braking force to the hammer piston. Also, in the period during which the hammer piston descends, because the upper air hole is closed by the operating piston the connection between the upper air chamber and the crank chamber is cut off. Consequently, because the descent of the operating piston causes the pressure inside the upper air chamber to increase rapidly it is possible to accelerate the hammer piston. As a result, the efficiency with which the engine output is converted into striking force is raised and it is possible to greatly increase the breaking force of the breaker.

Therefore, with this invention, it is possible to reduce the size of the engine and make a breaker which as a whole is small, light and easy to handle and has a simple construction which can be manufactured cheaply.

Other features and merits of the invention will become clear from the following detailed description and drawings of a specific preferred embodiment thereof, but as long as the basic features of the invention are provided an engine-driven breaker according to the invention is not limited to the construction shown in the following preferred embodiment and it will be clear to a person skilled in the art that various changes are possible without exceeding the scope of the invention.

DETAILED DESCRIPTION OF THE PREFERRED EMBODIMENTS

Figure 1:
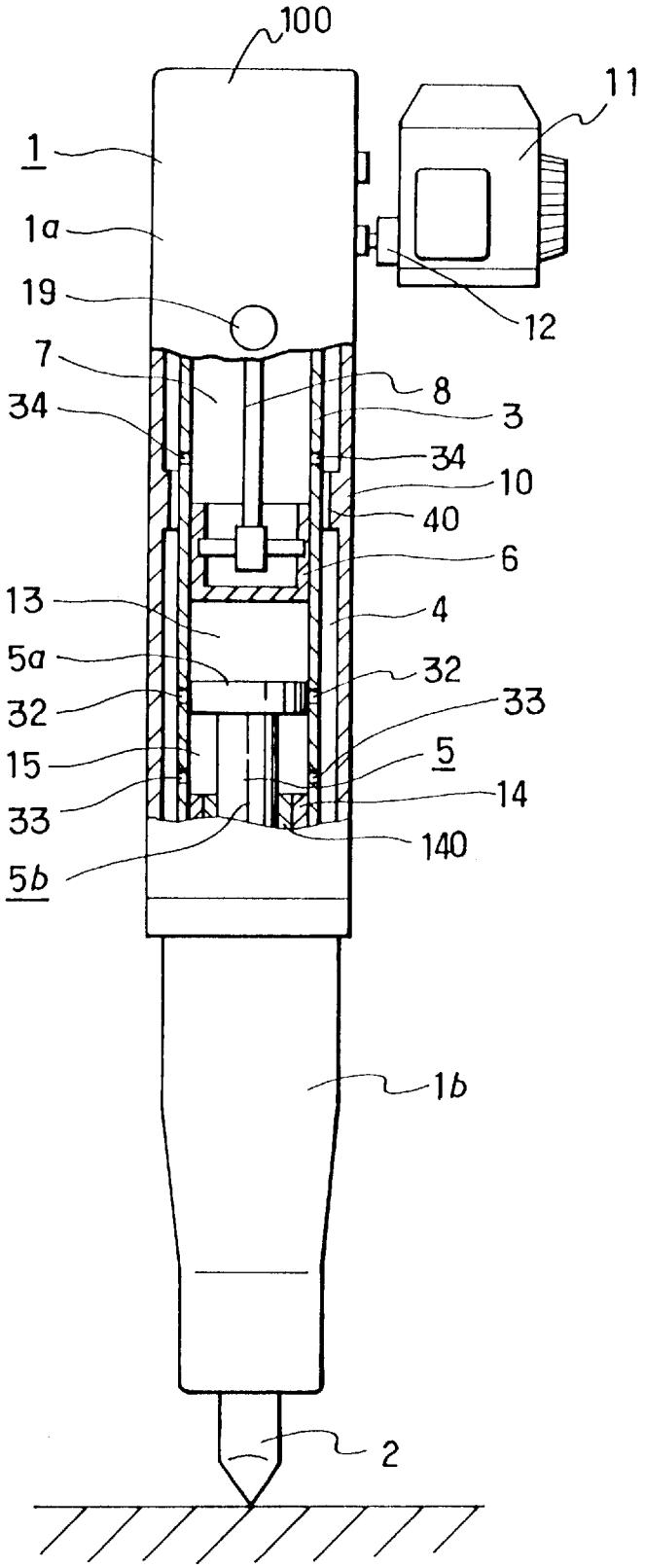
FIG. 1 is a partially sectional side view of a preferred embodiment of an engine-driven breaker according to the invention.

A preferred embodiment of the invention will now be described with reference to the accompanying drawings.

FIG. 1 through FIG. 8 show a preferred embodiment of an engine-driven breaker according to the invention.

In the drawings, a breaker main body 1 is made up of a cylindrical upper body 1*a* and a cylindrical front end 1*b*, and these are rigidly joined together end-to-end by means of bolts or the like not shown in the drawings. The upper body 1*a* has a ceiling part 100, and consequently its inside is airtight. An engine 11 for driving the breaker is mounted on the outside of the upper part of the upper body 1*a*, and an operating handle 19 is attached to the upper part of the upper body 1*a* in a different position from the engine 11.

The reference numeral 2 denotes a tool such as a chisel attached to the front end 1*b* on the center axis thereof by way of a bush 21.

The reference numeral 3 denotes a hollow cylinder having its upper end open. This cylinder 3 is disposed inside the upper body 1*a* concentrically with the upper body 1*a* and a flange 30 formed at its lower end is airtightly fixed to the lower end of the upper body 1*a*. A plug 14 serving as a partition wall is fitted in the lower end of the cylinder 3 and forms a bottom part of the cylinder 3. A bearing element 140 such as a metal bush is fixed inside the plug 14. The plug 14 is fixed in an opening in the front end 1*b* by a flange formed at its lower end, and the breaker main body 1 is thereby divided into upper and lower parts.

The cylinder 3 has an outer diameter suitably smaller than the inner diameter of the upper body 1*a*, and an annular air passage 4 is formed between the outer peripheral surface of the cylinder 3 and the inside surface of the upper body 1*a*. This annular air passage 4 has its lower end blocked by the flange 30 formed on the lower end of the cylinder 3.

A throttling passage 40 of reduced cross-sectional area is provided between the outer peripheral surface of the cylinder 3 and the inside surface of the upper body 1*a* and at a height level suitably below the top dead center position of an operating piston 6, which will be further discussed later, the annular air passage 4 is locally partitioned by this throttling passage 40 and the space above the throttling passage 40 forms a crank chamber 7.

The cylinder 3 extends into this crank chamber 7, and there is an annular space between the cylinder outer periphery and the inside surface of the upper body 1*a*. The crank chamber 7 includes this annular space and houses a crank mechanism which will be further discussed later.

The throttling passage 40 is obtained in this preferred embodiment by an inside flange 10 of such a size that it does not reach the outer peripheral surface of the cylinder 3 being provided on the inside wall of the upper body 1*a*. However, instead of this the inside flange 10 may be made of such a size that it makes contact with the outer peripheral surface of the cylinder 3 and multiple through holes may be provided passing through this flange in its thickness direction. Alternatively, the throttling passage 40 may be obtained by a flange of such a diameter that it does not reach the inside wall of the upper body 1*a* being provided on the outer periphery of the cylinder 3.

The reference numeral 5 denotes a hammer piston disposed inside the cylinder 3. This hammer piston 5 has a piston part 5*a* slidably making contact with the cylinder inside wall, a rod part 5*b* concentric with the cylinder is provided extending from the underside of this piston part 5*a*, and the rod part 5*b* passes through the bearing element 140 and projects into the front end 1*b* and faces the tool 2.

The reference numeral 6 denotes an operating piston slidably fitted inside the cylinder 3 through the opening in the upper end of the cylinder. An upper air chamber 13 of variable volume is formed between the lower surface of this operating piston 6 and the upper surface of the piston part 5*a*, and a lower air chamber 15 of variable volume is formed between the lower surface of the piston part 5*a* and the plug 14 serving as the bottom of the cylinder.

The operating piston 6 is connected to the engine 11 by way of a crank mechanism.

Figure 2:
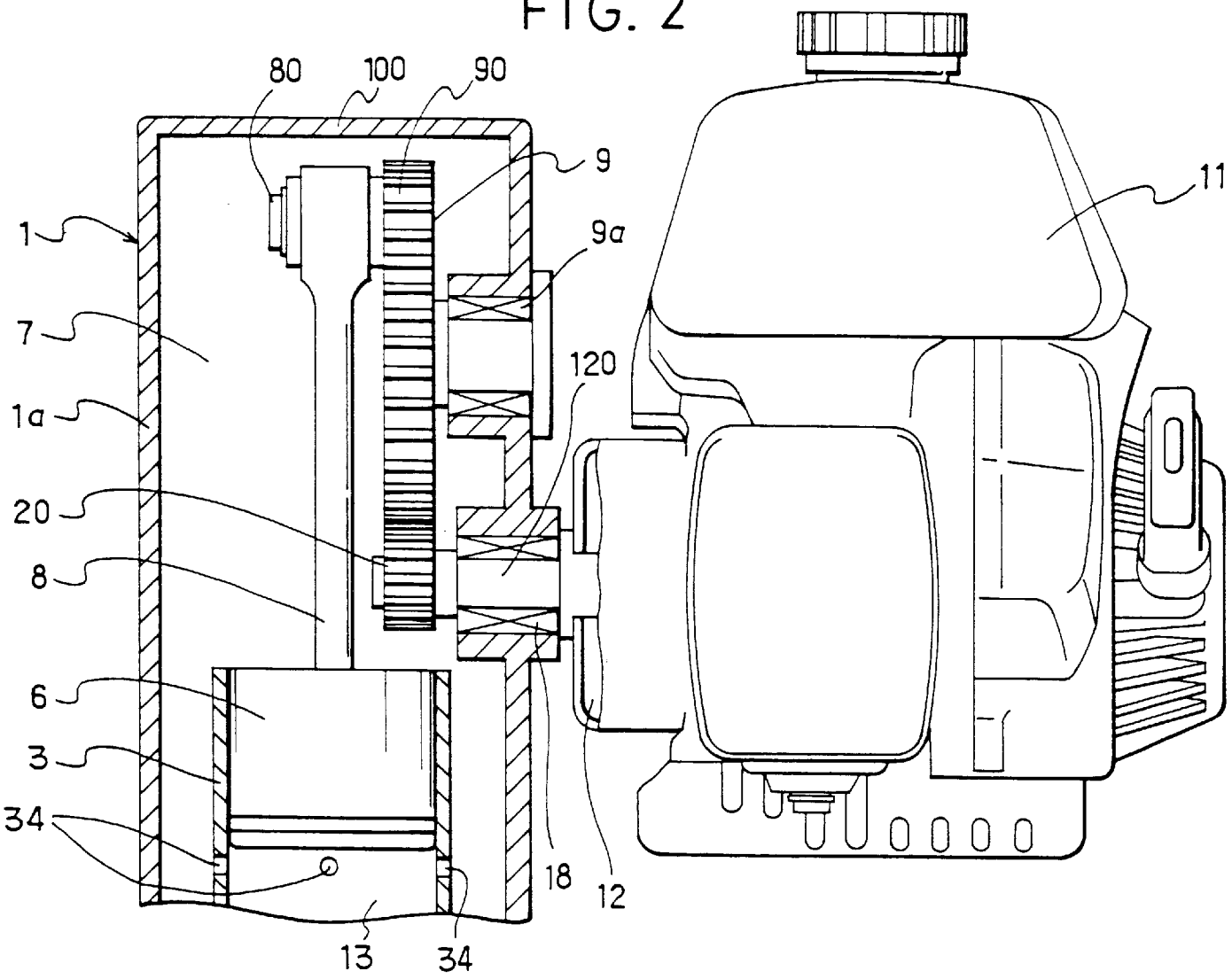
FIG. 2 is an enlarged view of an upper part of the engine-driven breaker.

That is, as shown in FIG. 2, the lower end of a connecting rod 8 is connected to the operating piston 6. The connecting rod 8 is connected by way of a support shaft 80 to a peripheral part of a rotatable crank shaft 9 inside the crank chamber. The crank shaft 9 in this preferred embodiment is disc-shaped and has its center supported on the upper body 1*a* by a bearing 9*a*, and a gear 90 is provided around the periphery of the crank shaft 9 as a power transmission element.

A clutch 12 such as a centrifugal clutch is connected to the output shaft of the engine 11, an output shaft 120 of this clutch 12 extends through a bearing 18 into the crank chamber and a driving gear 20 meshing with the above-mentioned gear 90 is fixed to the end of this output shaft 120. FIG. 2 shows the state shown in FIG. 6 wherein the operating piston 6 is in its top dead center position.

Figure 3:
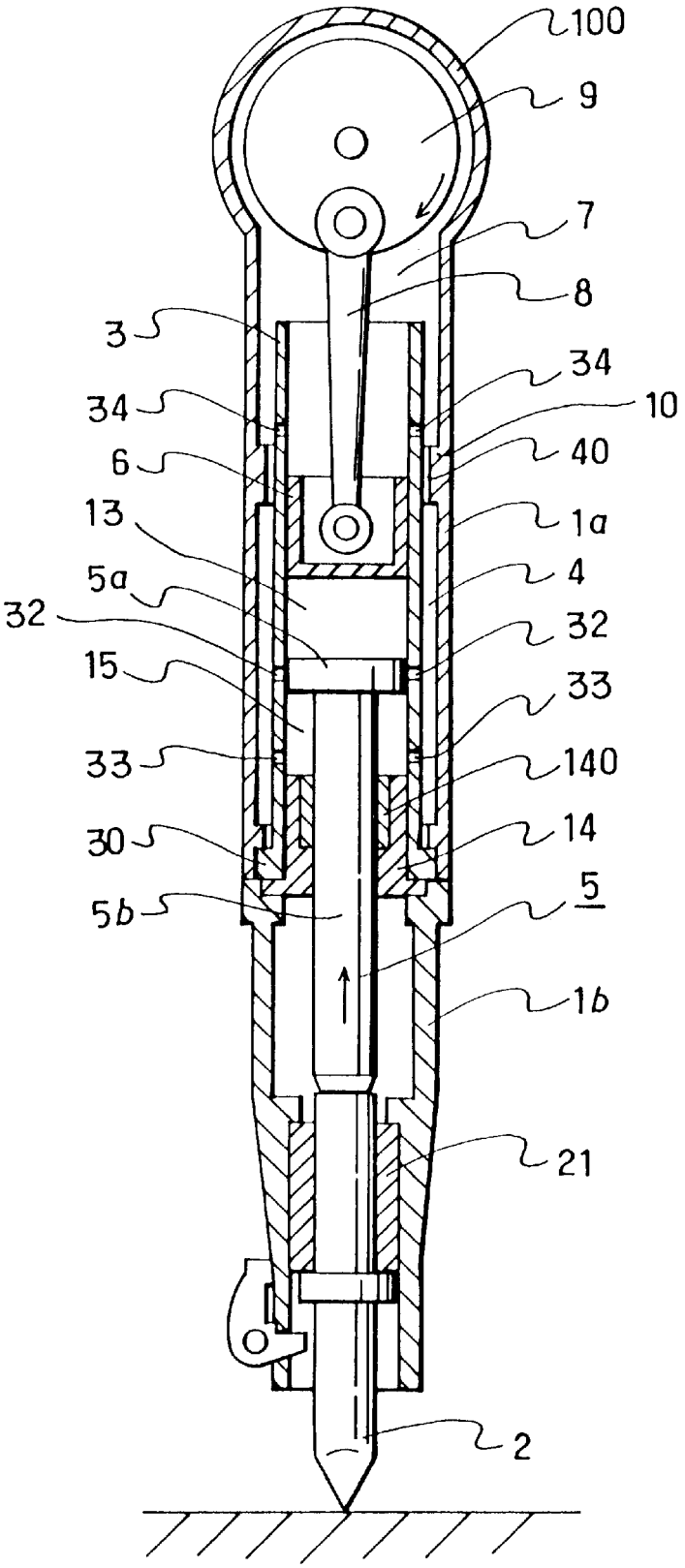
FIG. 3 is a vertical front view of the breaker after completion of striking.
Figure 8:
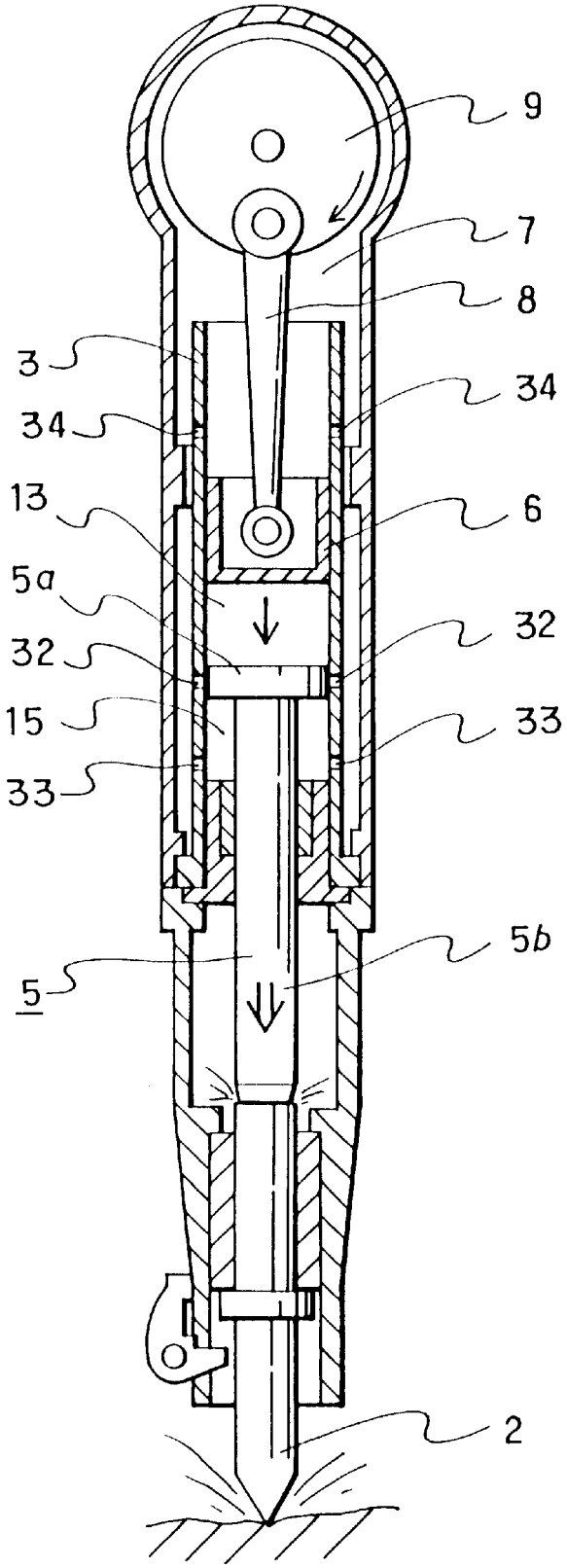
FIG. 8 is a vertical sectional front view showing the state of the breaker on striking.

A plurality of first air holes 32 and a plurality of second air holes 33 are respectively provided in the wall of the cylinder 3 in different positions in the vertical direction. The first air holes 32 are provided in such a position that they are closed by the peripheral surface of the piston part 5*a* when the hammer piston 5 reaches its bottom dead center position as shown in FIG. 3 and FIG. 8. The second air holes 33 are provided a position below the position of the piston part 5*a* when the hammer piston 5 is at bottom dead center and preferably near the plug 14 so that they connect the annular air passage 4 and the lower air chamber 15 at all times.

Also, in this preferred embodiment, a plurality of upper air holes 34 connecting to the crank chamber 7 are provided in the wall of the cylinder 3. These upper air holes 34 are provided in a position within the sliding range of the operating piston 6 and in a position at a level above the throttling passage 40 and such that they are not blocked by the peripheral wall of the operating piston 6 when the operating piston 6 has reached its top dead center position, that is, in a position at a level slightly below the lower end of the operating piston 6 when the operating piston 6 is in its top dead center position.

In this preferred embodiment the upper body 1*a* of the breaker main body 1 consists of a single body, but alternatively it may be two-part in the circumferential direction and airtightly joined or may be divided into upper and lower parts at the crank chamber 7 and airtightly joined. Also, the crank shaft does not necessarily have to be a disc.

Also, the cylinder 3 may integrally have a bottom part equivalent to the plug 14. In this case, that bottom part constitutes the partition wall and the plug 14 is dispensed with.

The operation of an engine-driven breaker according to the invention will now be described.

When the engine 11 is driven, by way of the clutch 12 the output thereof is applied to the driving gear 20 and by the gear 90 meshing with this the crank shaft 9 is rotated inside the crank chamber 7 at a reduced speed. As a result, the operating piston 6 connected to the crank shaft 9 by the connecting rod 8 reciprocates up and down inside the cylinder 3.

When no tool 2 is attached to the breaker, or when the breaker main body 1 has been lifted off the surface to be broken and the tool 2 has fallen until it abuts with a catch for preventing it from falling out of the breaker main body 1, the rod part 5*b* of the hammer piston 5 falls to below its bottom dead center position and the piston part 5*a* reaches a position below the first air holes 32. In this state, even if the operating piston 6 reciprocates all that happens is that air passes between the upper air chamber 13 and the annular air passage 4 through the first air holes 32, and the upper air chamber 13 does not reach a negative pressure. Consequently, the hammer piston 5 does not operate and no-load striking is prevented.

When a tool 2 is attached to the breaker main body 1 and the tool 2 is brought into contact with a surface to be broken, the rod part 5*b* of the hammer piston 5 is pushed up by the tool 2 and as shown in FIG. 3 the piston part 5*a* reaches its bottom dead center position. Because as a result of this the first air holes 32 are closed by the peripheral surface of the piston part 5*a*, the upper air chamber 13 between the upper surface of the piston part 5*a* and the lower surface of the operating piston 6 becomes sealed.

Figure 4:
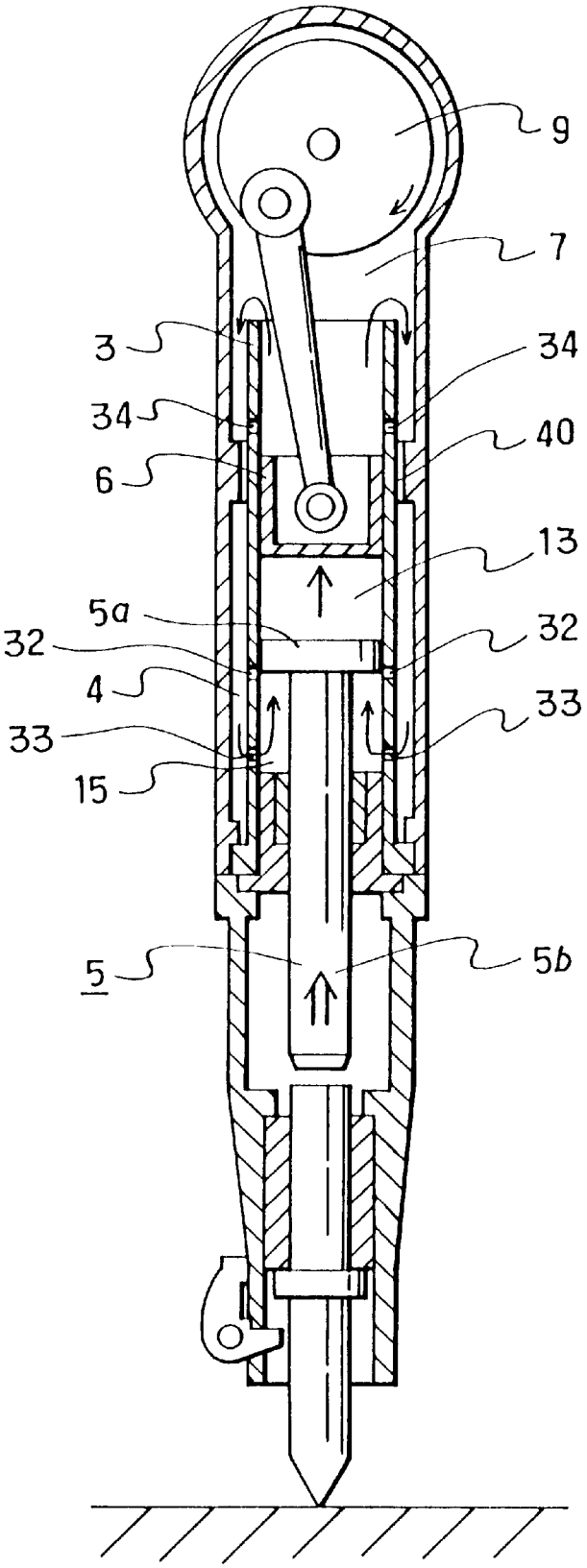
FIG. 4 is a vertical sectional front view showing the state of the breaker shortly after commencement of an ascent of an operating piston thereof.

When as the rotation of the crank shaft 9 continues the operating piston 6 starts to ascend from its bottom dead center position, as shown in FIG. 4, the upper air chamber 13 assumes a negative pressure due to enlargement of its volume. Meanwhile, the volume of the crank chamber 7 decreases due to the ascent of the operating piston 6. As a result, the air inside the crank chamber 7 is compressed and as shown by the arrows in FIG. 4 this compressed air passes through the throttling passage 40 and flows into the annular air passage 4 and flows into the lower air chamber 15 below the piston part 5*a* through the second air holes 33 which connect to the annular air passage 4 at all times, and the pressure inside the lower air chamber 15 starts to increase. Consequently, the hammer piston 5 is pushed upward by a difference in pressure between the upper air chamber 13 and the lower air chamber 15 and starts to ascend.

When from the state shown in FIG. 4 the rotation of the crank shaft 9 continues and the operating piston 6 ascends, because the upper air holes 34 are closed by the peripheral surface of the operating piston 6, the connection between the upper air chamber 13 and the crank chamber 7 is cut off. This continues for the duration of the stroke of the height of the operating piston 6. During this time, air compressed as a result of decrease in the volume of the crank chamber 7 continues to pass through the throttling passage 40 and flow into the annular air passage 4.

Figure 5:
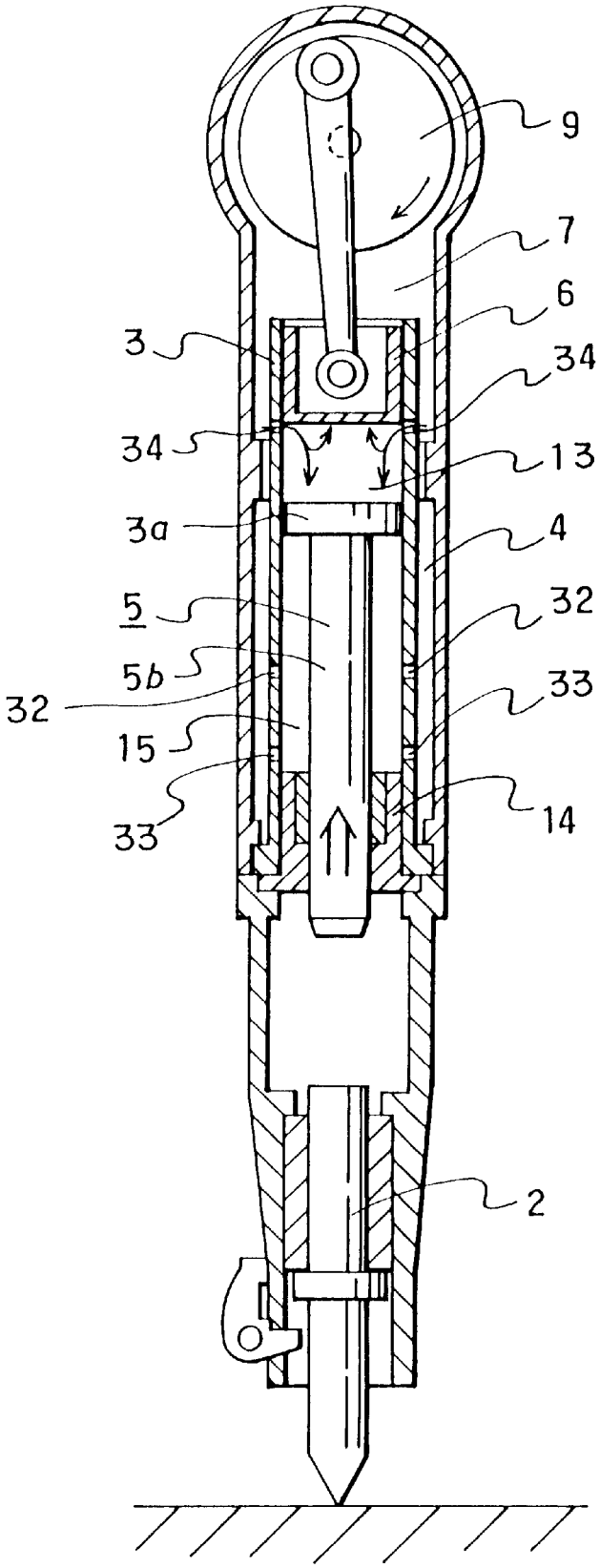
FIG. 5 is a vertical sectional front view showing the state of the breaker immediately before the operating piston reaches top dead center.

When then as shown in FIG. 5 the operating piston 6 ascends to a position immediately before top dead center, the upper air holes 34 are opened and the crank chamber 7 and the upper air chamber 13 are connected. As a result, as shown in FIG. 5, air compressed in the crank chamber 7 passes through the upper air holes 34 and flows into the upper air chamber 13 between the operating piston 6 and the piston part 5*a*.

As a result, the state of negative pressure that there had been in the upper air chamber 13 is released and the pressure difference between the upper air chamber 13 and the lower air chamber 15 becomes almost nil and the lifting force on the piston part 5*a* ceases to exist and consequently the hammer piston 5 ascends under inertia only. Also, because the upper air chamber 13 and the lower air chamber 15 are almost at the same pressure, due to the difference in the pressure-receiving areas of the upper and lower surfaces of the piston part 5*a* a braking force acts on the hammer piston 5 and reduces its speed. Furthermore, as a result of the upper air chamber 13 reaching a positive pressure the force pulling up the operating piston 6 need only overcome frictional force and the load on the engine 11 is reduced.

Figure 6:
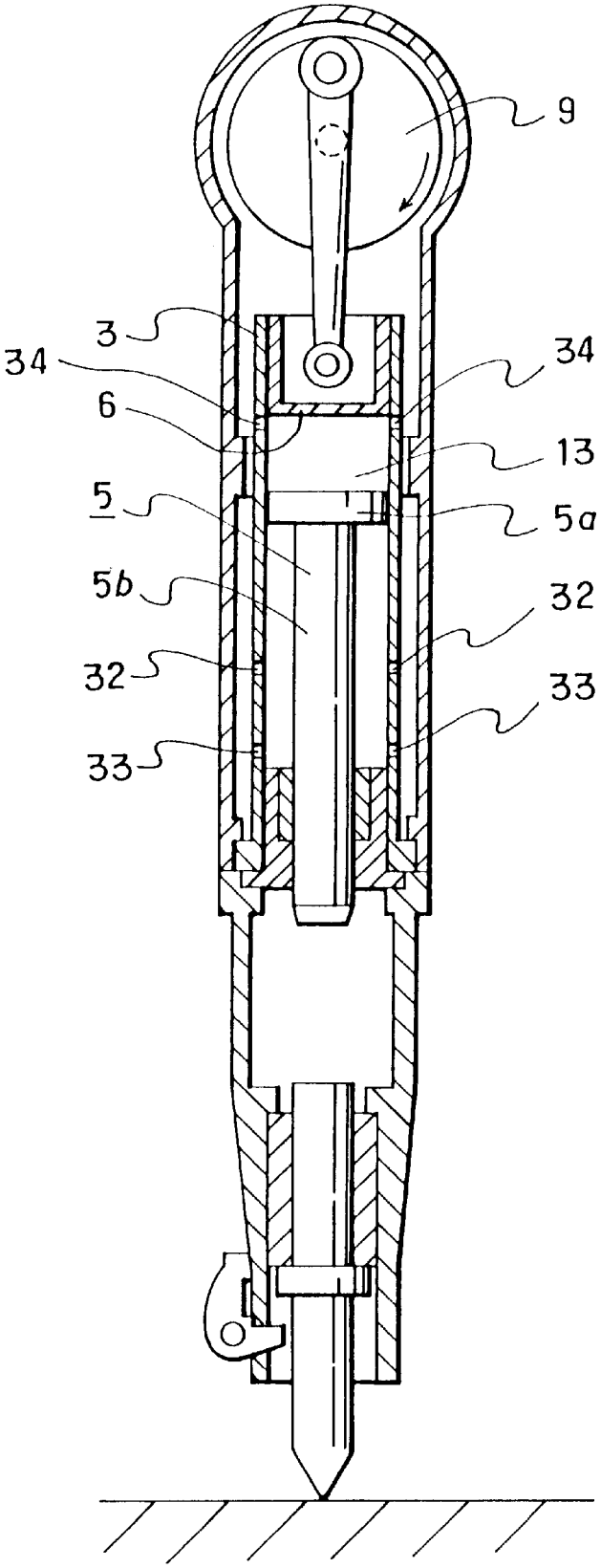
FIG. 6 is a vertical sectional front view showing the state of the breaker when the operating piston reaches top dead center.

As the crank shaft 9 rotates further the operating piston 6 reaches top dead center as shown in FIG. 6, but in this position also the upper air holes 34 are open. Therefore, until the upper air holes 34 are closed by the downward stroke of the operating piston 6, which will be further discussed later, the upper air chamber 13 is kept at a positive pressure. Consequently, an engine torque sufficient to overcome the frictional force between the operating piston 6 and the cylinder 3 is sufficient and therefore the load on the engine is reduced.

Figure 7:
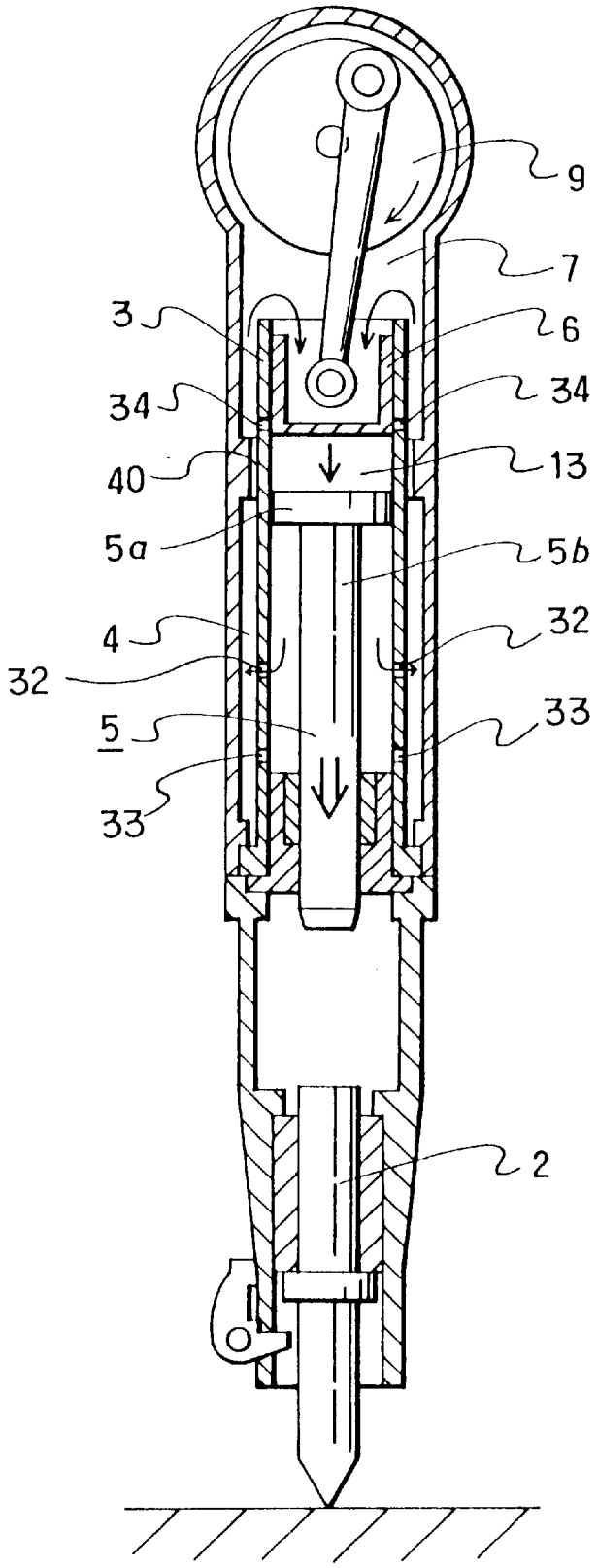
FIG. 7 is a vertical sectional front view showing the state of the breaker shortly after commencement of a descent of the operating piston.

When the crank shaft 9 rotates further the operating piston 6 starts to descend, as shown in FIG. 7. As a result the upper air holes 34 are closed again by the outer peripheral surface of the operating piston 6 and the upper air chamber 13 becomes airtight and cut off from the crank chamber 7 and consequently the air inside the upper air chamber 13 is compressed. At this time, because the hammer piston 5 has been reduced in speed as described above, the energy needed to brake the hammer piston 5 is small, and a large engine torque is not needed.

When from this state this way the hammer piston 5 ascends and stops and moves into its descending stroke, because the air inside the upper air chamber 13 is compressed by the descent of the operating piston 6, the hammer piston 5 continues to be pushed down. At this time, air inside the lower air chamber 15 below the piston part 5*a* passes through the open first air holes 32 and the second air holes 33 and flows out into the annular air passage 4, and because this air flows into the crank chamber 7 while having its flowrate throttled by the throttling passage 40, the force lowering the operating piston 6 is effectively supplemented.

As a result, the hammer piston 5 is accelerated downward and as shown in FIG. 8 the end of the rod part 5*b* strikes the tool 2 when the piston part 5*a* reaches its bottom dead center position. Because the air in the upper air chamber 13 is compressed from its state of having returned to a positive pressure, the pressure difference between the upper air chamber 13 and the lower air chamber 15 becomes large and as a result the energy applied to the hammer piston 5 also increases and a large striking force can be obtained. Also, because the compressed air in the upper air chamber 13 has a cushion effect, there is no possibility of the hammer piston 5 and the operating piston 6 colliding and no countermeasure to such collision is necessary.

When the hammer piston 5 strikes the tool 2 in this way, the hammer piston 5 enters an ascending stroke under the reaction force of that impact. Here, the state of the breaker returns to that shown in FIG. 3 and the operation described above is repeated.

One of the characteristic features of the invention is the provision of the upper air holes 34 in the cylinder 3. When the upper air holes 34 are not provided in the cylinder 3, the following kinds of phenomena occur. That is, when from the state shown in FIG. 3 the crank shaft 9 rotates and the operating piston 6 ascends, the upper air chamber 13 reaches a negative pressure because its volume increases. Also, because air compressed in the crank chamber 7 flows into the lower air chamber 15 through the second air holes 33, the hammer piston 5 ascends due to the pressure difference between the upper and lower air chambers. In a state wherein striking operation is being carried out continuously, the reaction force of when the hammer piston 5 impacts the tool 2 also becomes a lifting force.

When then the crank shaft 9 rotates further and the operating piston 6 passes top dead center it starts to descend, but at this time the upper air chamber 13 is still at a negative pressure. Meanwhile, a lifting force is acting on the hammer piston 5 and the hammer piston 5 continues to ascend. When the crank shaft 9 rotates further and the air in the upper air chamber 13 starts to be compressed by the operating piston 6 a braking force due to the pressure difference between the upper air chamber 13 and the lower air chamber 15 acts on the ascent of the hammer piston 5 and when the pressure inside the upper air chamber 13 rises further the hammer piston 5 is rapidly accelerated by the force exerted by this pressure and strikes the head of the tool.

In this mechanism, the following problems arise. The force reversing the hammer piston 5 ascending under an impact reaction force and air pressure into the striking stroke arises only from energy compressing the air in the upper air chamber 13 by the descending operating piston 6. Also, because until immediately before the upper air chamber 13 reaches a positive pressure a lifting force acts on the hammer piston 5, a large energy is required to stop the ascent of this hammer piston 5. Because of these points, momentarily a large engine torque is required and consequently an engine of large output is necessary.

Also, the upper air chamber 13 is at a negative pressure in its upward stroke, and inevitably the timing at which this becomes a positive pressure and this pressure rises is late. Consequently, the probability of the hammer piston 5 and the operating piston 6 colliding is high and a separate countermeasure to prevent this is necessary.

In contrast with this, in the present invention, as described above this problem can be solved by providing the upper air holes 34 in the cylinder 3. As a result, compared to the striking mechanism described above not having the upper air holes 34, even with about ⅔ of the engine output the same performance (striking force, striking frequency) can be obtained. Furthermore, because the construction of an engine-driven breaker according to the invention is simple, there is the great advantage that it can be manufactured cheaply.

What is claimed is:

1. An engine-driven breaker comprising:

a cylindrical breaker main body (1) having an upper end closed and divided into upper and lower parts by a partition wall located part-way in the height direction and having a tool (2) attached thereto below the partition wall;

a cylinder (3) fixed inside the breaker main body (1) above the partition wall;

a hammer piston (5) having a piston part (5*a*) and a rod part (5*b*), the piston part (5*a*) being slidably fitted inside the cylinder (3) and the rod part (5*b*) extending downward through the partition wall, which hammer piston (5) strikes the tool (2) with the rod part (5*b*) when the piston part (5*a*) descends;

an engine (11) mounted on the outside of the breaker main body (1); and an operating piston (6) slidably fitted inside the cylinder (3) above the piston part (5*a*) and raised and lowered by a crank mechanism connected to the engine (11), wherein an upper air chamber (13) of variable volume is formed between the piston part (5*a*) of the hammer piston (5) and the operating piston (6) and a lower air chamber (15) of variable volume is formed between the piston part (5*a*) of the hammer piston (5) and a cylinder bottom, a throttling passage (40) is provided between the outer periphery of the cylinder (3) and the inner periphery of the breaker main body (1) and an annular air passage (4) and a crank chamber (7) housing the crank mechanism are formed respectively below and above this throttling passage (40) as a boundary, a first air hole (32) connecting with the annular air passage (4) and closed by the piston part (5*a*) when the hammer piston (5) reaches a bottom dead center position is provided in a cylinder wall of the cylinder (3) and a second air hole (33) always connecting the annular air passage (4) and the lower air chamber (15) is provided in the cylinder wall below the bottom dead center position of the hammer piston (5), and an upper air hole (34) for connecting the upper air chamber (13) and the crank chamber (7) is provided in a part of the cylinder wall positioned inside the crank chamber (7) in a position at a height level above the throttling passage (40) and below the top dead center position of the operating piston (6).

2. An engine-driven breaker according to claim 1, wherein:

when the operating piston (6) and the hammer piston (5) ascend from their bottom dead center positions the inside of the upper air chamber (13) is brought to a negative pressure by the ascent of the operating piston (6) and air inside the crank chamber (7) is compressed as the chamber volume of the crank chamber (7) decreases and flows through the throttling passage (40) into the annular air passage (4) and further passes through this annular air passage (4) and through the second air hole (33) and the first air hole (32) into the lower air chamber (15) and lifts the hammer piston (5), the upper air hole (34) is closed by the ascent of the operating piston (6) and opens immediately before the operating piston (6) reaches top dead center whereupon the crank chamber (7) and the upper air chamber (13) are connected and air from the crank chamber (7) flows into the upper air chamber (13) and applies a braking force to the hammer piston (5), and immediately after the operating piston (6) starts to descend from top dead center the upper air hole (34) is closed whereby the upper air chamber (13) is sealed and air inside the upper air chamber (13) is then compressed by continuing descent of the operating piston (6) and pushes down the hammer piston (5) and the pressure inside the lower air chamber (15) is decreased by air being discharged through the first air hole (32) and the second air hole (33) into the annular air passage (4) and air discharged into the annular air passage (4) is fed into the crank chamber (7) through the throttling passage (40) and applies a downward force on the operating piston (6).

3. An engine-driven breaker according to claim 1, wherein:

the first air hole (32) and the second air hole (33) and the upper air hole (34) each consist of a plurality of holes provided spaced around the circumference of the cylinder wall.

4. An engine-driven breaker according to claim 1, wherein:

the breaker main body (1) has an upper body (1*a*) and a front end (1*b*) and the tool (2) is attached to the front end (1*b*) and a plug (14) serving as a partitioning wall is disposed at the boundary between the upper body (1*a*) and the front end (1*b*) and this plug (14) fits airtightly into the lower end of the cylinder (3) and constitutes the cylinder bottom.

5. An engine-driven breaker according to claim 3, wherein:

the throttling passage (40) is formed by providing an inside flange on the inner wall of the upper body (1*a*).

* * * * *